US010765153B2

(12) United States Patent
Rendone

(10) Patent No.: US 10,765,153 B2
(45) Date of Patent: Sep. 8, 2020

(54) STRAP CONFIGURATION FOR A SUPPORT GARMENT

(71) Applicant: NIKE, Inc., Beaverton, OR (US)

(72) Inventor: Nicole Rendone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 251 days.

(21) Appl. No.: 16/028,847

(22) Filed: Jul. 6, 2018

(65) Prior Publication Data

US 2019/0037930 A1 Feb. 7, 2019

Related U.S. Application Data

(60) Provisional application No. 62/540,376, filed on Aug. 2, 2017.

(51) Int. Cl.
*A41C 3/00* (2006.01)
*A41F 15/00* (2006.01)

(52) U.S. Cl.
CPC ..... *A41C 3/0028* (2013.01); *A41C 3/00* (2013.01); *A41F 15/002* (2013.01); *A41C 3/0078* (2013.01)

(58) Field of Classification Search
CPC ..... A41C 3/0028; A41C 3/00; A41F 15/002
USPC ..... 450/86, 85, 82
See application file for complete search history.

(56) References Cited

U.S. PATENT DOCUMENTS 1,926,078 A 9/1933 Ruthada
2,156,478 A * 5/1939 Kemp ..... A41F 1/006 450/85
2,521,373 A * 9/1950 Hutchison ..... A41C 3/00 450/77
3,935,865 A * 2/1976 Newmar ..... A41C 3/0078 450/64
4,276,884 A 7/1981 O'Daniels
4,300,568 A * 11/1981 Blanckmeister ..... A41F 1/006 450/85

(Continued)

FOREIGN PATENT DOCUMENTS

CA 2429494 C 8/2007
CA 2964855 A1 4/2016

(Continued)

OTHER PUBLICATIONS

International Search Report and Written Opinion dated Nov. 7, 2018 in International Patent Application No. PCT/US2018/044820, 17 pages.

(Continued)

*Primary Examiner* — Gloria M Hale
(74) *Attorney, Agent, or Firm* — Shook, Hardy and Bacon LLP

(57) ABSTRACT

Aspects herein are directed to a support garment having a single strap adjustment mechanism. A first end of the strap is adjustably secured to an upper margin of a first breast contacting surface, and a second end of the strap is adjustably secured to an upper margin of a second breast contacting surface. An intervening portion of the strap is configured such that as the strap extends from its first end, it crosses diagonally downward to a first aperture located on a wing portion of the support garment through which it passes. It then crosses horizontally to pass through a second aperture located on another wing portion of the support garment. It then crosses diagonally upward where it terminates at its second end.

17 Claims, 7 Drawing Sheets

(56) References Cited

U.S. PATENT DOCUMENTS

| | | | | |
|---|---|---|---|---|
| 5,149,293 | A | 9/1992 | Gable | |
| 5,634,891 | A | 6/1997 | Beczak | |
| 6,110,007 | A | 8/2000 | Rittmann | |
| 6,547,636 | B1 * | 4/2003 | Cato | A41C 3/0028 450/86 |
| 8,808,213 | B2 | 8/2014 | Hendricks | |
| 9,408,420 | B2 | 8/2016 | Betts | |
| 9,615,616 | B2 | 4/2017 | Corrado | |
| 2008/0299870 | A1 | 12/2008 | Penunuri | |
| 2011/0081827 | A1 | 4/2011 | Williams | |
| 2011/0117818 | A1 | 5/2011 | Barnard | |
| 2012/0122369 | A1 | 5/2012 | Tyrer | |
| 2012/0129426 | A1 * | 5/2012 | Tyrer | A41C 3/0021 450/31 |
| 2013/0203319 | A1 | 8/2013 | Torres | |
| 2016/0081398 | A1 | 3/2016 | Tempesta | |
| 2017/0055602 | A1 | 3/2017 | Abraham | |
| 2018/0325185 | A1 * | 11/2018 | Sakai | A41C 3/0028 |

FOREIGN PATENT DOCUMENTS

| | | | |
|---|---|---|---|
| CN | 204273281 | U | 4/2015 |
| EP | 1696753 | B1 | 7/2008 |
| FR | 2880244 | B1 | 4/2007 |
| FR | 2983684 | B1 | 2/2014 |
| GB | 364931 | A | 1/1932 |
| GB | 424143 | A | 2/1935 |
| JP | H02118704 | U | 9/1990 |
| JP | H09296307 | A | 11/1997 |
| TW | M342756 | U | 10/2008 |
| WO | WO2016175804 | A1 | 11/2016 |
| WO | WO2017015452 | A1 | 1/2017 |

OTHER PUBLICATIONS

International Preliminary Report on Patentability received for PCT Patent Application No. PCT/US2018/044820, dated Feb. 13, 2020, 10 pages.

Forever 21 Strappy Layered Mesh Bralette. PoshMark, poshmark.com, accessed: Jun. 2017.

Body Glove Leelo High Neck Bikini Top. PacSun, pacsun.com, accessed: Jun. 2017.

Shefit Sports Bra; Fitness Apparel. Kick Starter, kickstarter.com, Aug. 19, 2013.

* cited by examiner

STRAP CONFIGURATION FOR A SUPPORT GARMENT

CROSS-REFERENCE TO RELATED APPLICATIONS

This application, assigned U.S. application Ser. No. 16/028,847, filed Jul. 6, 2018, and entitled "Strap Configuration for a Support Garment," claims the benefit of priority of U.S. Prov. App. No. 62/540,376, entitled "Strap Configuration for a Support Garment, and filed Aug. 2, 2017. The entirety of the aforementioned application is incorporated by reference herein.

TECHNICAL FIELD

Aspects herein are directed to a strap configuration for a support garment.

BACKGROUND

Typical strap configurations for support garments such as a bra utilize a right shoulder strap and a separate and distinct left shoulder strap. Each of the right and left shoulder straps must be independently manipulated to effect an adjustment of the right breast cup and the left breast cup respectively of the support garment.

BRIEF DESCRIPTION OF THE DRAWINGS

Examples of the present invention are described in details below with reference to the attached drawing figures, wherein.

DETAILED DESCRIPTION

Figure 1:
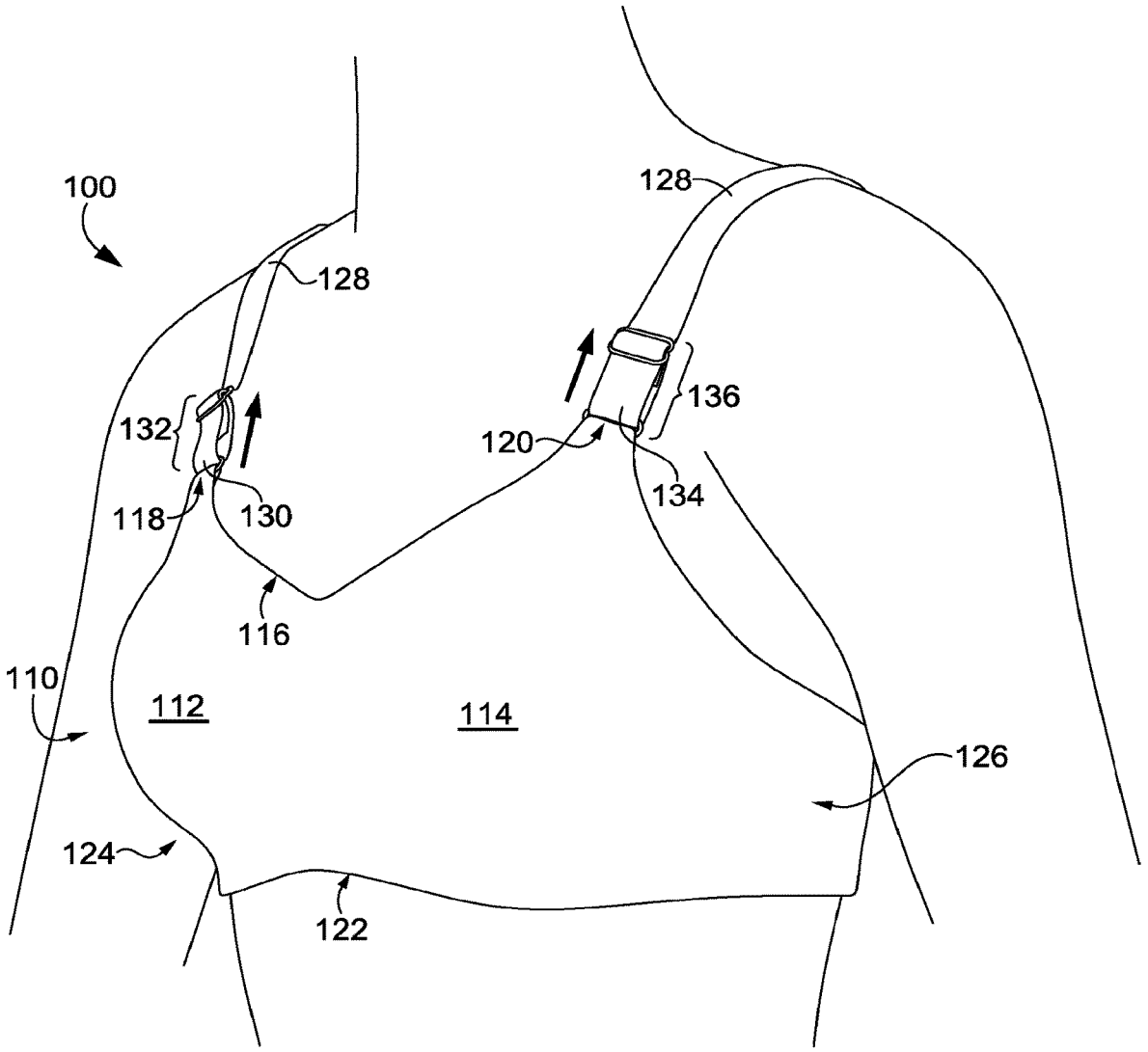
FIG. 1 illustrates a front perspective view of an example support garment being worn by a wearer in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a support garment having a single strap configuration that enables a wearer to initiate an adjustment of, for example, a first support portion of the support garment using the strap and have that adjustment translate, via the strap, to a second support portion of the support garment, and even to a third support portion of the support garment. For instance, when the support garment is in the form of a bra, the wearer may initiate an adjustment of a first breast contacting surface using the single strap and have that adjustment translate to a substantially simultaneous adjustment of the second breast contacting surface of the bra and to a substantially simultaneous adjustment of an underband portion of the bra.

In example aspects, the support garment may comprise a front portion having at least an upper margin, a first breast contacting surface, a second breast contacting surface, a first side, and a second side. The upper margin may comprise a first securing location positioned at an upper portion of the first breast contacting surface and a second securing location positioned at an upper portion of the second breast contacting surface. Continuing, a first wing may extend laterally away from the first side of the front portion and terminate in a first terminal end. Similarly, a second wing may extend laterally away from the second side of the front portion and terminate in a second terminal end. A first through-aperture may be positioned on the first wing proximate the first terminal end, and a second through-aperture may be positioned on the second wing proximate the second terminal end. In example aspects, the first aperture is ipsilateral to the first securing location and contralateral to the second securing location, and the second aperture is ipsilateral to the second securing location and contralateral to the first securing location.

Regarding the strap configuration, the support garment comprises a single, continuous strap having a first end, a second end, and an intervening portion extending between the first end and the second end. In one example configuration, the first end of the strap is adjustably secured to the first securing location of the front portion, and the second end of the strap is adjustably secured to the second securing location of the front portion. In one example configuration, the intervening portion is configured such that as the strap extends from its first end, it crosses diagonally to the second aperture through which it passes. It then crosses horizontally from the second terminal end of the second wing to the first terminal end of the first wing where it passes through the first aperture. It then crosses diagonally to the second securing location where it terminates at its second end.

This configuration enables a single adjustment movement to be translated to several different portions of the support garment. For example, when the strap is shortened using a first adjustment mechanism located at the first end of the strap, an upward tension is applied to the first breast contacting surface. The shortening of the strap is also translated to an upward tension applied to the second breast contacting surface. Further, due to the strap crossing horizontally between the first and second apertures located on the wings of the front portion, tightening of the strap via the first adjustment mechanism would cause the first terminal end to be tensioned toward the second terminal end thereby decreasing the girth of the support garment and increasing the support in the underband portion of the support garment.

Accordingly, aspects herein are directed to a support garment comprising a front portion comprising at least an upper margin having a first securing location and a second securing location, where the front portion further comprises a first aperture and a second aperture. The support garment further comprises a single, continuous strap having a first end, a second end, and an intervening portion extending between the first end and the second end. The first end of the strap is adjustably secured to the first securing location of the front portion, the second end of the strap is adjustably secured to the second securing location of the front portion, and the intervening portion extends through the first aperture and the second aperture.

In another aspect, a support garment is provided comprising a front portion comprising an upper margin with a first securing location and a second securing location, where the front portion further comprises a first side, and a second side. The support garment additionally comprises a first wing extending laterally away from the first side of the front portion and terminating in a first terminal end, the first wing comprising a first aperture, and a second wing extending laterally way from the second side of the front portion and terminating in a second terminal end, the second wing comprising a second aperture. The first aperture of the first wing is ipsilateral to the first securing location and contralateral to the second securing location, and the second aperture of the second wing is ipsilateral to the second securing location and contralateral to the first securing location. The support garment additionally comprises a single strap having a first end adjustably secured to the first securing location, a second end adjustably secured to the second securing location, and an intervening portion extending between the first end and the second end, where the intervening portion traverses the first aperture and the second aperture.

In yet another aspect, a support garment is provided comprising a front portion comprising an upper margin with a first securing location and a second securing location. The front portion further comprises a lower margin, a first side, and a second side. The support garment additionally comprises a first wing extending laterally away from the first side of the front portion and terminating in a first terminal end, the first wing comprising a first aperture, and a second wing extending laterally away from the second side of the front portion and terminating in a second terminal end, the second wing comprising a second aperture. The first aperture of the first wing is ipsilateral to the first securing location and contralateral to the second securing location, and the second aperture of the second wing is ipsilateral to the second securing location and contralateral to the first securing location. The support garment additionally comprises a strap extending from the first securing location and traversing the second aperture, the strap subsequently traversing the first aperture, and the strap terminating at the second securing location.

The term "support garment" as used herein is meant to encompass any number of support garments such as bras, tank tops, camisoles with built-in support, swimming suit tops, body suits, and other styles or types of support garments used to support breast tissue. Further, the term "breast contacting surface" as used herein is meant to encompass any type of structure that is in contact with the wearer's breasts when the support garment is worn. For instance, each breast contacting surface may comprise a breast cup such as a molded cup, or an unmolded cup. The breast contacting surfaces may comprise separate distinct components with each contacting surface configured to cover or encapsulate a separate breast, or the breast contacting surfaces may comprise a unitary or continuous band of material that makes contact with both of the wearer's breasts. Any and all aspects, and any variation thereof, are contemplated as being within aspects herein.

Positional terms used herein such as "superior," "inferior," "medial," "lateral," "upper," "lower," "side," "front," "back," "horizontal," "contralateral," "ipsilateral," "outer-facing surface," "inner-facing surface," and the like are to be given their common meaning with respect to the support garment being worn as intended and as shown and described herein by a hypothetical wearer standing in an upright position (i.e., standing in anatomical position). Still further, the phrase "configured to contact," or other similar phrases used when describing different portions of the support garment in relation to a wearer refer to a support garment appropriately sized for the particular wearer. Terms such as "fixedly secured" as used herein generally refer to attachment methodologies between two or more elements that generally maintain the elements in a fixed relationship with respect to one another. Terms such as "adjustably secured" as used herein refer to attachment methodologies that allow at least one element, such as a strap, to be adjusted (e.g., shortened or lengthened) in relation to another element, such as a breast contacting surface.

Figure 2:
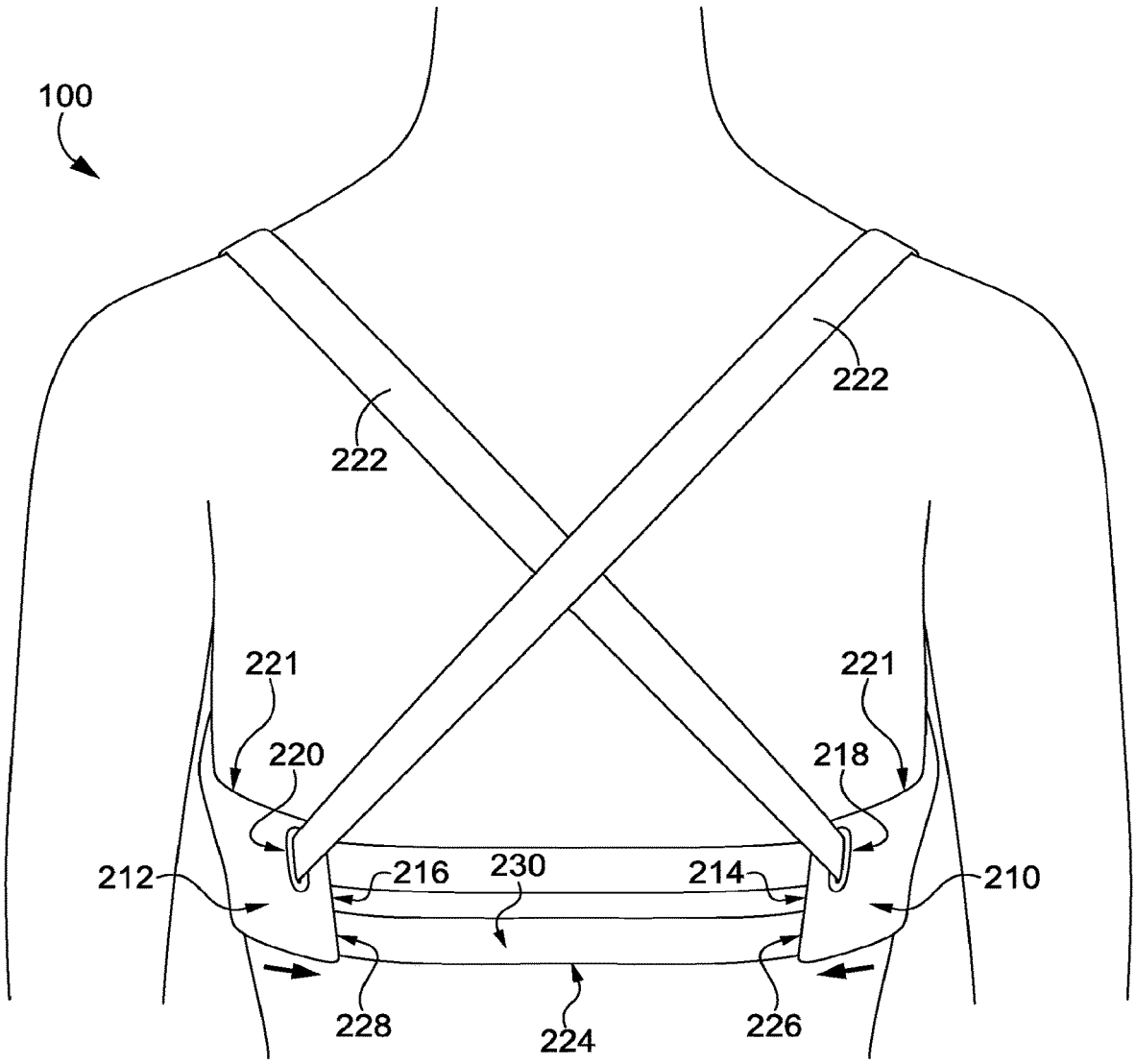
FIG. 2 illustrates a back view of an example strap configuration for the support garment of FIG. 1 in accordance with aspects herein.

Turning now to FIGS. 1 and 2, front and back views respectively of an example support garment 100 being worn by a wearer are shown in accordance with aspects herein. The support garment 100 shown in FIGS. 1 and 2 is in the form of a bra, but as described herein, the support garment 100 may take other forms. Referring first to FIG. 1, the support garment 100 comprises a front portion 110 with a first breast contacting surface 112 and a second breast contacting surface 114, where the first breast contacting surface 112 is configured to contact at least a portion of a wearer's right breast when the support garment 100 is worn, and the second breast contacting surface 114 is configured to contact at least a portion of the wearer's left breast when the support garment 100 is worn. Each of the first breast contacting surface 112 and the second breast contacting surface 114 may extend from a medial aspect to a lateral aspect. That is, each of the first breast contacting surface 112 and the second breast contacting surface 114 may extend from location generally adjacent to a wearer's sternum when the support garment 100 is worn (i.e., a medial location) to a location generally adjacent to a wearer's side torso region when the support garment 100 is worn (i.e., a lateral location). Each breast contacting surface 112 and 114 may further extend from a lower margin 122 of the support garment 100 to an upper margin 116 of the support garment 100. The upper margin 116 of the front portion 110 comprises a first securing location 118 and a second securing location 120. The first securing location 118 is generally positioned at an upper portion of the first breast contacting surface 112, and the second securing location 120 is generally positioned at an upper portion of the second breast contacting surface 114.

Continuing, the front portion 110 further comprises the lower margin 122, a first side 124, and a second side 126. In aspects, the lower margin 122 may comprise a separate underband portion configured to at least partially encircle a torso area of a wearer below the wearer's breasts when the support garment 100 is worn, or the lower margin 122 may not comprise a separate component (i.e., it may, instead, comprise an integral extension of the front portion 110) but still function as an underband portion configured to at least partially encircle a torso area of a wearer below the wearer's breasts when the support garment 100 is worn. Any and all aspects, and any variation thereof, are contemplated as being within the scope herein. The first side 124 of the front portion 110 is generally positioned lateral to the first breast contacting surface 112, and the second side 126 of the front portion 110 is generally positioned lateral to the second breast contacting surface 114.

With further respect to FIG. 1, the support garment 100 further comprises a single strap 128 having a first end 130 adjustably secured to the first securing location 118 using a first adjustment mechanism 132, and a second end 134 adjustably secured to the second securing location 120 using a second adjustment mechanism 136. Aspects herein contemplate the strap 128 being formed of an elastically resilient material. The first and second adjustment mechanisms 132/136 may comprise typical strap adjustment mechanisms used in, for instance, bras such as a single loop slider combined with a double loop slider, or they may comprise other types of adjustment mechanisms such as a single loop slider combined with a hook-and-loop fastener system on the strap and other similar configurations. Any and all aspects, and any variation thereof, are contemplated as being within aspects herein.

Figure 8:
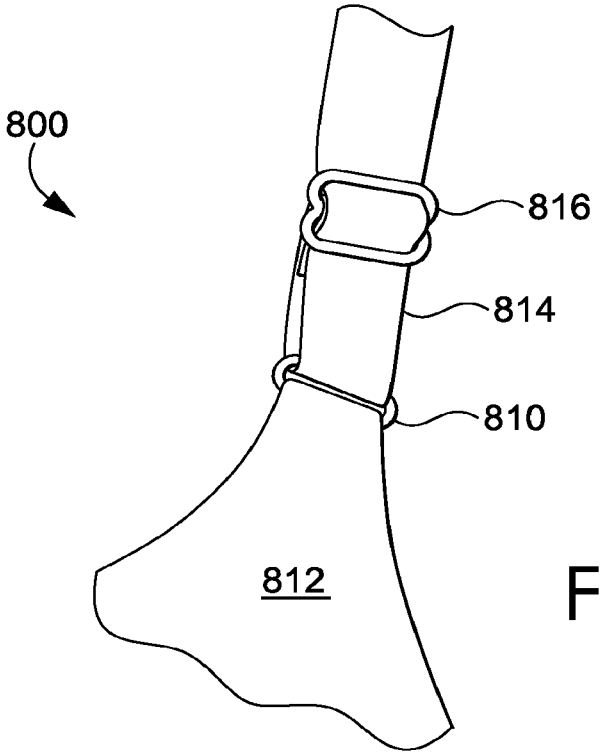
FIG. 8 illustrates an example slider mechanism associated with an example strap in accordance with aspects herein.

An example adjustment mechanism comprising a single loop slider in combination with a double loop slider is shown in FIG. 8 and is referenced generally by the numeral 800. A first end of a bra strap 814 is looped through a single loop slider 810 fixedly secured to an upper margin of a breast contacting surface 812 using for example, stitching, bonding, adhesives, welding, and the like. The first end of the strap 814 is further looped through a double-loop slider 816 before being secured to itself. The portion of the strap 814 extending away from the first end is also looped through the double-loop slider 816. Adjustment of the length of the strap 814 may be carried out by sliding the double-loop slider 816 away from the breast contacting surface 812 to shorten the strap 814 or toward the breast contacting surface 812 to lengthen the strap 814. As stated, this is a fairly typical way of adjusting the length of a support garment strap, and aspects herein are not limited to this particular construction. Any construction that allows a strap length to be shortened or lengthened is within the scope herein.

Turning now to FIG. 2, which depicts a back view of the support garment 100, the support garment 100 further comprises a first wing 210 that extends laterally way from the first side 124 of the front portion 110 and terminates in a first terminal end 214. Similarly, the support garment 100 comprises a second wing 212 that extends laterally away from the second side 126 of the front portion 110 and terminates in a second terminal end 216. In example aspects, the first terminal end 214 is spaced apart from the second terminal end 216 when the support garment 100 is in an as-worn configuration. To describe it another way, in example aspects, the first terminal end 214 is not directly affixed or secured to the second terminal end 216 (i.e., they do not directly contact each other when the support garment 100 is in the as-worn configuration). Although the first and second wings 210/212 are shown as extending generally around to a back torso region of a wearer in FIG. 2, it is contemplated herein that the wings 210/212 may extend around to just the sides of the wearer (e.g., extend to approximately the mid-axillary line of the wearer), to positions intermediate between that shown in FIG. 2 and the mid-axillary line of the wearer, or extend around the back torso region of the wearer such that they cover more of the wearer's back torso region than shown in FIG. 2. Any and all aspects, and any variation thereof, are contemplated as being within aspects herein.

Continuing, in example aspects, the first wing 210 comprises at least a first aperture 218 that extends through the thickness of the first wing 210 such that it acts as a through-passage. Similarly, the second wing 212 comprises at least a second aperture 220 that extends through the thickness of the second wing 212 such that it also acts as a through-passage. Both the first aperture 218 and the second aperture 220 may be located proximate to the first terminal end 214 and the second terminal end 216 respectively. As used herein, and unless noted otherwise, the term "proximate" may mean within 1.0 mm to 10 cm of a defined reference point. In the example configuration shown in FIG. 2, the first and second apertures 218/220 may also be located proximate an upper margin 221 of the first wing 210 and the second wing 212 respectively. Further, in example aspects, the first aperture 218 is positioned ipsilateral (i.e., on the same side of the support garment 100) to the first securing location 118 and contralateral (i.e., on the opposite side of the support garment 100) to the second securing location 120. As well, the second aperture 220 is positioned ipsilateral to the second securing location 120 and contralateral to the first securing location 118.

Figure 7:
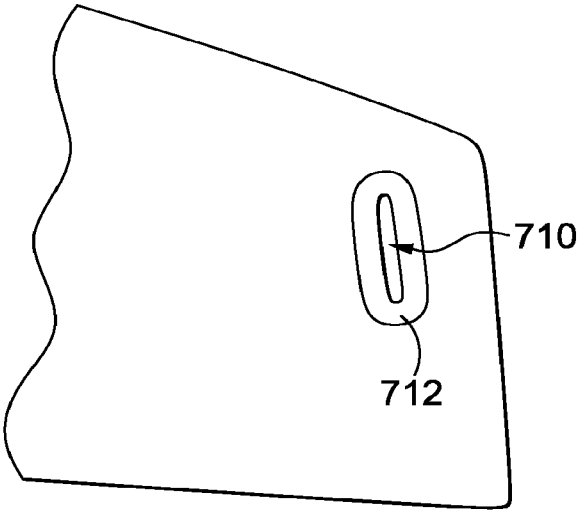
FIG. 7 illustrates an example aperture circumscribed by a reinforcement material in accordance with aspects herein.

In example aspects, the first and second apertures 218 and 220 may be reinforced with a reinforcement material. A depiction of this is shown in FIG. 7 which illustrates a view of an example aperture 710 in accordance with aspects herein. The aperture 710 may comprise the first aperture 218 and/or the second aperture 220 of FIG. 2. In example aspects, the aperture 710 is circumscribed or surrounded by a reinforcement material 712. The reinforcement material 712 may be positioned on just the outer-facing surface of the support garment 100, just the inner-facing surface of the support garment 100, or on both the outer-facing surface and the inner-facing surface of the support garment 100. The reinforcement material 712 may help to reduce the chances of the aperture 710 tearing or fraying through repeated use. The reinforcement material 712 may comprise, for instance, a metal grommet, stitching, an adhesive tape, a plastic grommet, a polymer layer, and the like.

Returning to FIG. 2, with respect to the strap 128, an intervening portion 222 of the strap 128 is primarily shown in FIG. 2. In an example aspect, the intervening portion 222 has a configuration such that the strap 128 extends from the first end 130 and passes over a wearer's shoulder when the support garment 100 is worn. The strap 128 then crosses diagonally downward in the back to the second aperture 220 located on the second wing 212. The strap 128 passes through the second aperture 220 and then extends horizontally from the second wing 212 to the first wing 210. Or to describe it a different way, the strap 128 extends horizontally between the second terminal end 216 and the first terminal end 214. Continuing, the strap 128 then extends through the first aperture 218 located on the first wing 210 and crosses diagonally upward in the back to pass over the wearer's shoulder where it terminates at the second end 134.

With respect to the passage or traversal of the strap 128 through the first and second apertures 218/220, the strap 128 may pass from an outer-facing surface of the second wing 212 to an inner-facing surface of the second wing 212 via the second aperture 220, and then pass from an inner-facing surface of the first wing 210 to an outer-facing surface of the first wing 210 via the first aperture 218 as shown in FIG. 2. However, it is contemplated herein that this configuration may be switched such that the strap 128 passes from an inner-facing surface of the second wing 212 to an outer-facing surface of the second wing 212 via the second aperture 220, and then passes from an outer-facing surface of the first wing 210 to an inner-facing surface of the first wing 210 via the first aperture 218. Any and all aspects, and any variation thereof, are contemplated as being within aspects herein.

As shown in FIG. 2, in an example aspect the support garment 100 may further comprise an optional second strap 224 that is positioned inferior to the strap 128. The second strap 224 comprises a first end 226, a second end 228, and an intervening portion 230 extending between the first end 226 and the second end 228. In one example aspect, the first end 226 may be fixedly attached, via, for instance, stitching, bonding, welding, and the like, to the first wing 210 proximate the first terminal end 214, and the second end 228 may be fixedly attached to the second wing 212 proximate the second terminal end 216 such that the intervening portion 230 extends horizontally between the first terminal end 214 and the second terminal end 216. In another example aspect, the strap 224 may comprise an adjustment mechanism (not shown) that allows the strap 224 to be shortened or lengthened. In aspects, the second strap 224 may be formed of an elastically resilient material that is configured to return to its resting state after being stretched. In aspects, the second strap 224 may act as an additional connection point between the first wing 210 and the second wing 212 and may, in combination with the strap 128, help to distribute any tensioning forces applied to the support garment 100 and specifically to the first and second wings 210 and 212 by the strap 128.

In use, a wearer may initiate a substantially simultaneous adjustment of multiple portions of the support garment 100 by manipulating, for example, the first adjustment mechanism 132 associated with the first end 130 of the strap 128. In instances where the strap 128 is shortened, an upward tension force would be applied to the first breast contacting surface 112. Because the strap 128 comprises a single, continuous strap, the tightening of the strap 128 would be translated to a simultaneous adjustment of the second breast contacting surface 114. In other words, the shortening of the strap 128 at the first end 130 would cause an upward tension to also be applied to the second breast contacting surface 114. Further, due to the traversal of the strap 128 through the first and second apertures 218 and 220, a shortening of the strap 128 would also cause the first terminal end 214 of the first wing 210 to be tensioned toward the second terminal end 216 of the second wing 212. In other words, due to the tightening of the strap 128 at the first end 130, the portion of the strap 128 that horizontally extends between the first and second terminal ends 214 and 216 is also shortened causing the two ends 214/216 to be pulled toward each other. This, in turn, causes a decrease in the circumferential girth of the support garment 100 at its lower margin 122 which can help to increase support to, for example, the lower portions of the wearer's breasts. A loosening of the strap 128 via the first adjustment mechanism 132 would cause an opposite effect to occur—a decrease in tensioning forces applied to the upper portions of the first and second breast contacting surfaces 112 and 114, and an increase in the girth of the support garment 100. Similar results would occur if the second adjustment mechanism 136 is used to tighten or loosen the strap 128 at its second end 134.

Figure 3:
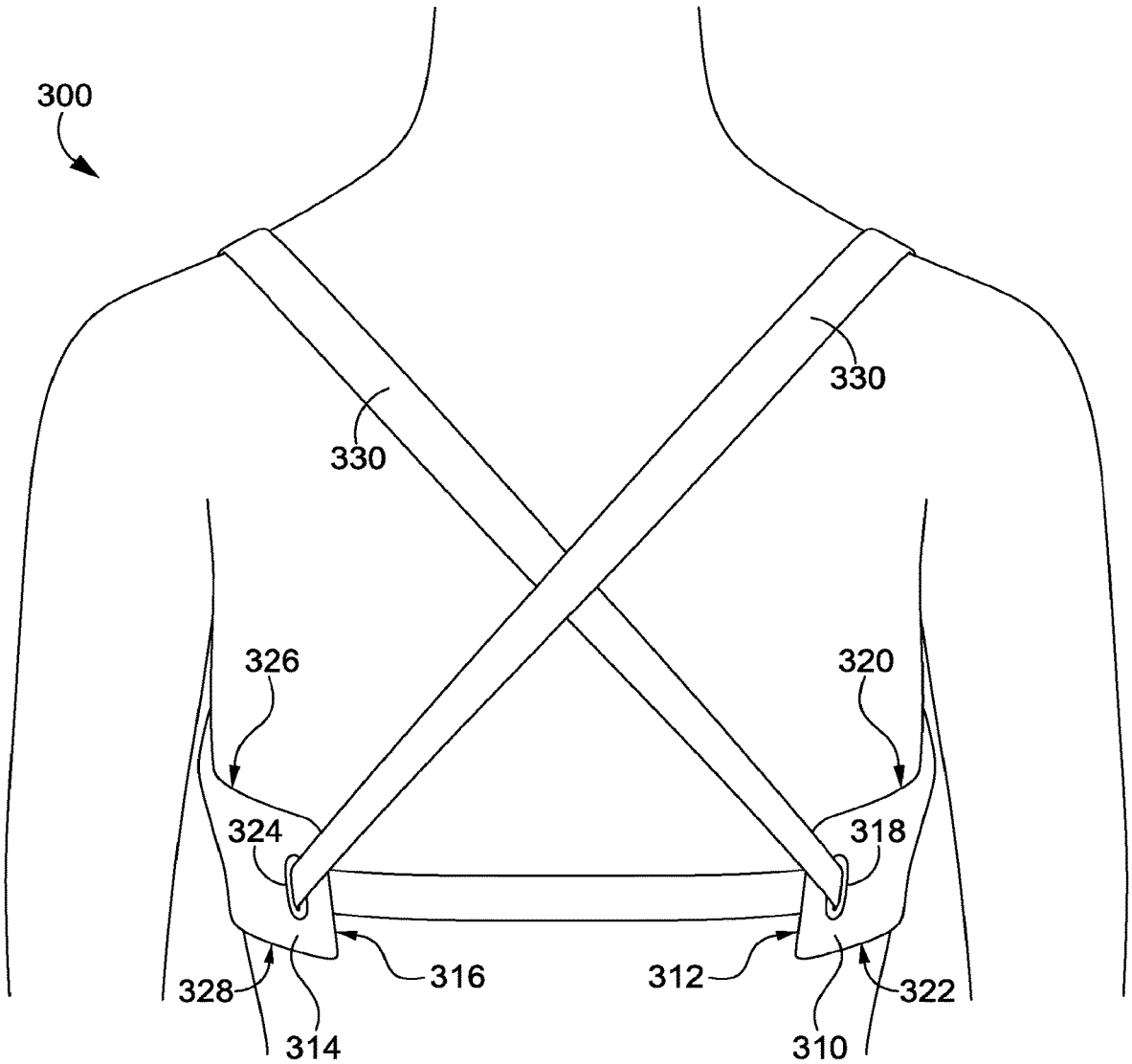
FIGS. 3-6 illustrate back views of alternative example strap configurations for the support garment of FIG. 1.

FIG. 3 illustrates a back view of a support garment 300 having another example strap configuration where the second strap 224 is not utilized in accordance with aspects herein. The support garment 300 includes many of the same features as the support garment 100 and, as such, these same features will not be discussed in detail. Instead, differences between the support garment 300 and the support garment 100 will be highlighted. Similar to the support garment 100, the support garment 300 comprises a first wing 310 terminating in a first terminal end 312, and a second wing 314 terminating in a second terminal end 316. The first wing 310 comprises a first aperture 318 located proximate the first terminal end 312 and positioned approximately midway between an upper margin 320 and a lower margin 322 of the first wing 310. Similarly, the second wing 314 comprises a second aperture 324 located proximate the second terminal end 316 and positioned approximately midway between an upper margin 326 and a lower margin 328 of the second wing 314.

The support garment 300 further comprises a single, continuous strap 330 that has a similar configuration to the strap 128 of the support garment 100. To better distribute the tensioning forces imparted to the first and second wings 310/314 by the strap 330, the strap 330 may, in example aspects, have a greater width than the strap 128, although it is also contemplated herein that the strap 330 may have the same or substantially the same width as the strap 128. To also help evenly distribute the tensioning forces imparted to the first and second wings 310/314 by the strap 330, the first and second apertures 318/324 may be positioned approximately midway between the respective upper and lower margins of the first and second wings 310/314.

Adjusting the support garment 300 may occur similar to the adjustment of the support garment 100. For example, shortening or lengthening the strap 330 at one end of the strap may cause a simultaneous adjustment of the first breast contacting surface, the second breast contacting surface, and the first and second wings 310 and 314 of the support garment 300.

Figure 4:
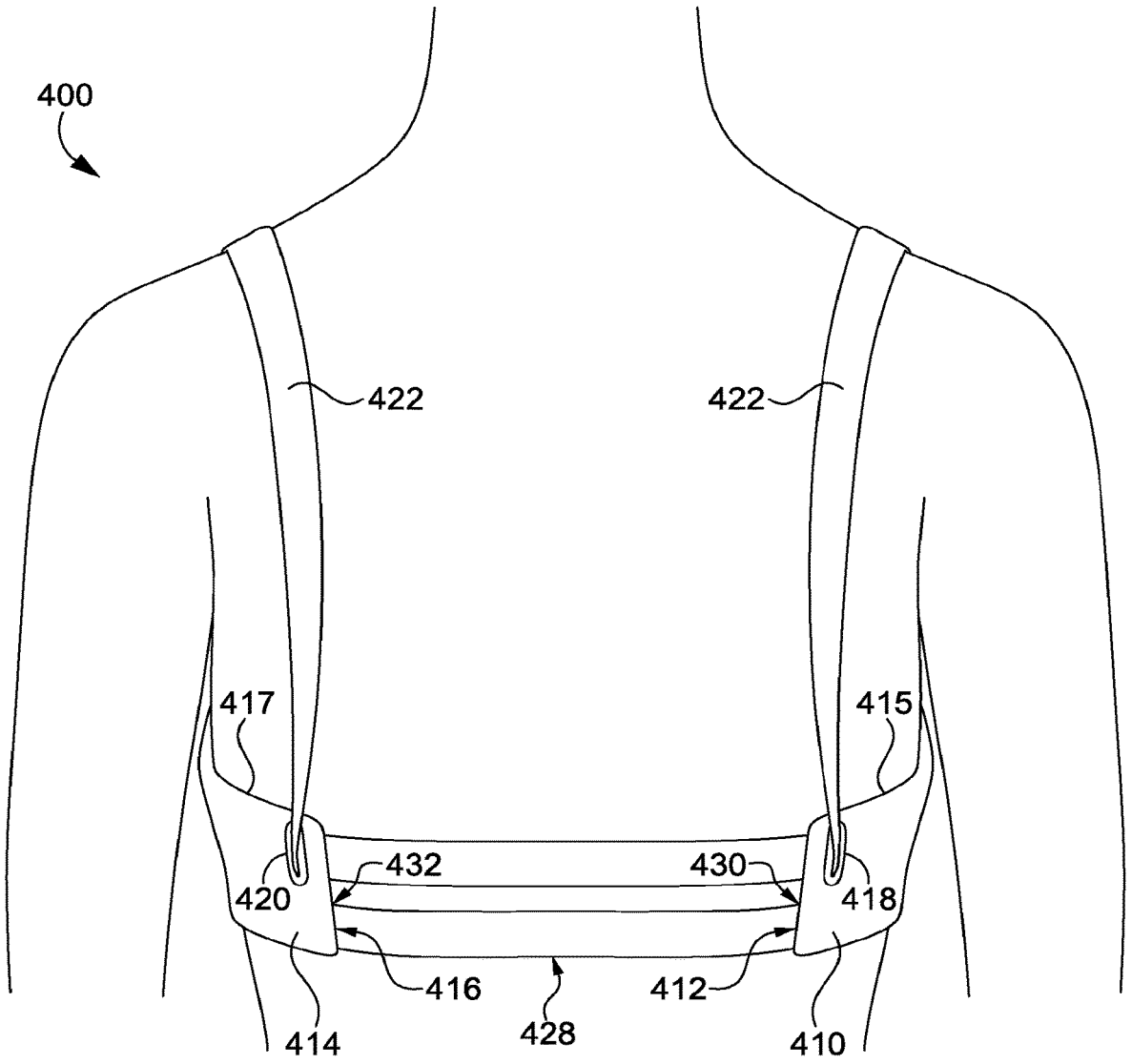

FIG. 4 illustrates a back view of yet another example strap configuration for a support garment 400 in accordance with aspects herein. The support garment 400 shares some of the features of the support garment 100 such as features associated with the front portion 110 and, as such, these same features will not be discussed in detail. Instead, differences between the support garment 400 and the support garment 100 will be highlighted. In this aspect, the support garment 400 includes a first wing 410 terminating in a first terminal end 412, and a second wing 414 terminating in a second terminal end 416. The support garment 400 further comprises a first aperture 418 located on the first wing 410 proximate the first terminal end 412 and proximate an upper margin 415 of the first wing 410, and a second aperture 420 located proximate the second terminal end 416 and proximate an upper margin 417 of the second wing 414.

Continuing, the support garment 400 comprises a single, continuous strap 422 having a first end, such as first end 130 of FIG. 1, adjustably secured to a first breast contacting surface, such as first breast contacting surface 112 of FIG. 1, and a second end, such as second end 134 of FIG. 1, adjustably secured to a second breast contacting surface, such as the second breast contacting surface 114 of FIG. 1, of the support garment 400. Instead of having a "criss-cross" configuration, the strap 422 has a configuration in which the strap 422 extends from the first end, passes over the shoulder of the wearer, and extends vertically downward to traverse the first aperture 418. The strap 422 then passes horizontally and between the first terminal end 412 and the second terminal end 416 to pass through the second aperture 420. From the second aperture 420, the strap 422 extends vertically upward to pass over the shoulder of the wearer where it terminates at its second end. Adjustment of, for example, the first end of the strap 422 is translated to a simultaneous adjustment of the second end of the strap 422 and to an adjustment of the first and second wings 410 and 414 due to the transverse crossing of the strap 422 between the first and second terminal ends 412 and 416.

With further respect to FIG. 4, the support garment 400 also comprises a second strap 428 positioned inferiorly to the strap 422. The second strap 428 has a first end 430 fixedly secured to the first terminal end 412, a second end 432 fixedly secured to the second terminal end 416, and an intervening portion extending between the first and second terminal ends 412 and 416. This configuration of the second strap 428 is similar to that of the support garment 100. In aspects, the strap 428 may comprise an adjustment mechanism (not shown) to enable shortening or lengthening of the strap although it is contemplated herein that an adjustment mechanism may not be used.

Figure 5:
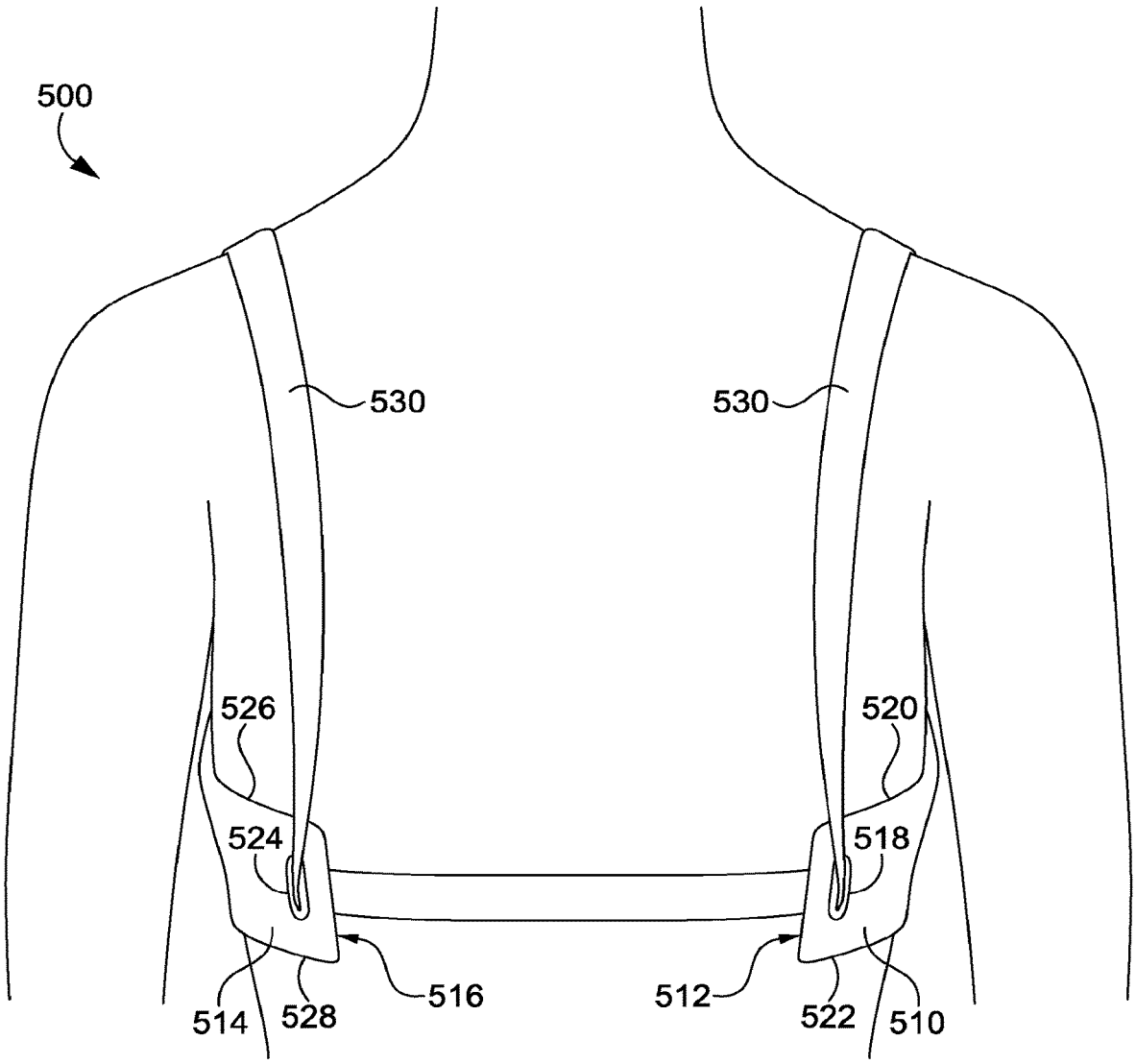

FIG. 5 illustrates a back view of yet another support garment 500 having an example strap configuration in accordance with aspects herein. The support garment 500 shares some of the features of the support garment 100 such as features associated with the front portion 110 and, as such, these same features will not be discussed in detail. Instead, differences between the support garment 500 and the support garment 100 will be highlighted. The support garment 500 comprises a first wing 510 terminating in a first terminal end 512, and a second wing 514 terminating in a second terminal end 516. The first wing 510 comprises a first aperture 518 located proximal to the first terminal end 512 at a position approximately midway between an upper margin 520 and a lower margin 522 of the first wing 510. The second wing 514 comprises a second aperture 524 located proximate the second terminal end 516 at a position approximately midway between an upper margin 526 and a lower margin 528 of the support garment 500.

The support garment 500 comprises a single, continuous strap 530 that has a configuration similar to the strap 422 of the support garment 400. The support garment 500, however, may not comprise the second strap as shown for the support garment 100 and the support garment 400. To help more evenly distribute the tensioning forces imparted to the first and second wings 510/514 by the strap 530, the strap 530 may comprise a wider width than, for example, the strap 422. And the location of the first and second apertures 518/524 may be adjusted to be positioned more centrally between the upper and lower margins of the first and second wings 510/514 as opposed to being located proximate the upper margin of the wings 510/514 as shown for the support garment 100 and the support garment 400.

Figure 6:
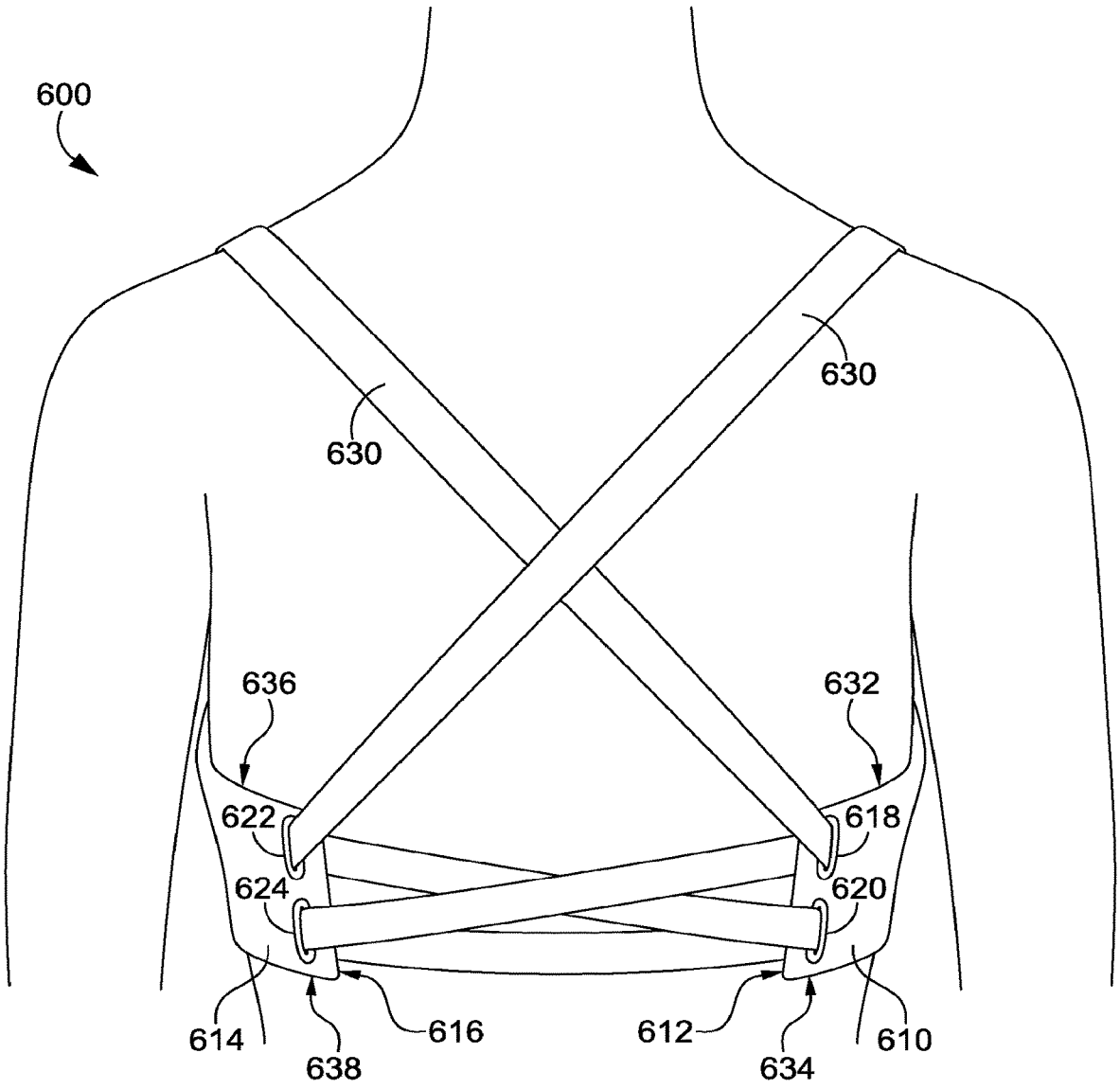

FIG. 6 illustrates a back view of yet another support garment 600 having an example strap configuration in accordance with aspects herein. The support garment 600 shares some of the features of the support garment 100 such as features associated with the front portion 110 and, as such, these same features will not be discussed in detail. Instead, differences between the support garment 600 and the support garment 100 will be highlighted. The support garment 600 comprises at least a first wing 610 terminating in a first terminal end 612, and a second wing 614 terminating in a second terminal end 616. In this configuration, the first wing 610 comprises a first aperture 618 and a second aperture 620. Similarly, the second wing 614 comprises a third aperture 622 and a fourth aperture 624. The first, second, third, and fourth apertures 618/620/622/624 all comprise through apertures that extend through the thickness of the first and second wings 610/614 respectively.

With respect to the apertures 618 and 620, the first aperture 618 is located proximal to the first terminal end 612 and is further located proximal to an upper margin 632 of the first wing 610. The second aperture 620 is located inferior to the first aperture 618 and is further located proximal to the first terminal end 612 and proximal to a lower margin 634 of the first wing 610. Continuing, with respect to the apertures 622 and 624, the third aperture 622 is located proximal to the second terminal end 616 and is further located proximal to an upper margin 636 of the second wing 614. The fourth aperture 624 is located inferior to the third aperture 622 and is further located proximal to the second terminal end 616 and proximal to a lower margin 638 of the second wing 614.

The support garment 600 comprises a single, continuous strap 630 having a first end (not seen in FIG. 6) adjustably secured to a first breast contacting surface and a second end (not seen in FIG. 6) adjustably secured to a second breast contacting surface. With respect to the strap configuration in the back of the support garment 600, in example aspects, the strap 630 extends from its first end, passes over a wearer's shoulder and then crosses diagonally downward to pass through the third aperture 622 located on the second wing 614. The strap 630 then crosses diagonally downward between the second terminal end 616 and the first terminal end 612 to pass through the second aperture 620 located on the first wing 610. After passing through the second aperture 620, the strap 620 extends horizontally from the first terminal end 612 to the second terminal end 616 to pass through the fourth aperture 624. Continuing, the strap 630 then extends diagonally upward between the second terminal end 616 and the first terminal end 612 to pass through the first aperture 618 located on the first wing 610. After passing through the first aperture 618, the strap 630 then crosses diagonally upward, passes over the wearer's other shoulder and terminates at its second end. An adjustment of the first end of the strap 630 would be translated through the apertures 618, 620, 622, and 624 to an adjustment of the second end of the strap 630. The result of the strap configuration shown for the support garment 600 is similar to a corset-like lacing configuration. The use of this type of configuration may help to evenly distribute any tensioning forces applied to the strap 620.

The different strap configurations shown for the support garments 100, 300, 400, 500, and 600 are all contemplated as being within aspects herein. The different strap configurations shown for the support garments 100, 300, 400, 500, and 600 allow for the simultaneous adjustment of multiple, different support garment portions via manipulation of a single adjustment mechanism.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A support garment comprising:

a front portion comprising at least an upper margin having a first securing location and a second securing location, the front portion further comprising a first side, and a second side;

a first wing extending laterally away from the first side of the front portion and terminating in a first terminal end, the first wing comprising a first aperture;

a second wing extending laterally way from the second side of the front portion and terminating in a second terminal end, the second wing comprising a second aperture;

a continuous first strap having a first end, a second end, and an intervening portion extending between the first end and the second end, wherein:

the first end is adjustably secured to the first securing location of the front portion, the second end is adjustably secured to the second securing location of the front portion, and the intervening portion extends through the first aperture and the second aperture; and a second strap having a first end secured to the first terminal end of the first wing, a second end secured to the second terminal end of the second wing, and an intervening portion extending between the first end and the second end.

2. The support garment of claim 1, wherein the first terminal end of the first wing is not directly secured to the second terminal end of the second wing.

3. The support garment of claim 1, wherein the first aperture is ipsilateral to the first securing location and contralateral to the second securing location, and wherein the second aperture is ipsilateral to the second securing location and contralateral to the first securing location.

4. The support garment of claim 3, wherein the first strap extends from the first securing location, extends through the second aperture, subsequently extends through the first aperture, and terminates at the second securing location.

5. The support garment of claim 3, wherein the first strap extends from the first securing location, extends through the first aperture, subsequently extends through the second aperture, and terminates at the second securing location.

6. The support garment of claim 1, wherein each of the first aperture and the second aperture is circumscribed by a reinforcement material.

7. The support garment of claim 1, wherein each of the first end and the second end of the second strap are fixedly secured to the first terminal end and the second terminal end respectively.

8. A support garment comprising:

a front portion comprising an upper margin with a first securing location and a second securing location, the front portion further comprising a first side, and a second side;

a first wing extending laterally away from the first side of the front portion and terminating in a first terminal end, the first wing comprising a first aperture;

a second wing extending laterally away from the second side of the front portion and terminating in a second terminal end, the second wing comprising a second aperture, wherein the first aperture of the first wing is ipsilateral to the first securing location and contralateral to the second securing location, and wherein the second aperture of the second wing is ipsilateral to the second securing location and contralateral to the first securing location;

a first strap having:

a first end adjustably secured to the first securing location, a second end adjustably secured to the second securing location, and an intervening portion extending between the first end and the second end, the intervening portion traversing the first aperture and the second aperture; and a second strap having a first end, a second end, and an intervening portion extending between the first end and the second end, wherein the first end is secured to the first terminal end of the first wing, and the second end is secured to the second terminal end of the second wing.

9. The support garment of claim 8, wherein the first aperture is located proximate the first terminal end, and wherein the second aperture is located proximate the second terminal end.

10. The support garment of claim 9, wherein each of the first aperture and the second aperture is circumscribed with a reinforcement material.

11. The support garment of claim 8, wherein the first strap extends from the first securing location, extends through the second aperture, subsequently extends through the first aperture, and terminates at the second securing location.

12. The support garment of claim 8, wherein the first strap extends from the first securing location, extends through the first aperture, subsequently extends through the second aperture, and terminates at the second securing location.

13. The support garment of claim 8, wherein the second strap is formed of an elastically resilient material.

14. A support garment comprising:

a front portion comprising an upper margin with a first securing location and a second securing location, the front portion further comprising a lower margin, a first side, and a second side;

a first wing extending laterally away from the first side of the front portion and terminating in a first terminal end, the first wing comprising a first aperture;

a second wing extending laterally away from the second side of the front portion and terminating in a second terminal end, the second wing comprising a second aperture, wherein the first aperture of the first wing is ipsilateral to the first securing location and contralateral to the second securing location, and wherein the second aperture of the second wing is ipsilateral to the second securing location and contralateral to the first securing location;

a first strap extending from the first securing location and traversing the second aperture, the first strap subsequently traversing the first aperture, and the first strap terminating at the second securing location; and a second strap having a first end, a second end, and an intervening portion extending between the first end and the second end, wherein the first end is secured to the first terminal end of the first wing, and the second end is secured to the second terminal end of the second wing.

15. The support garment of claim 14, wherein the first strap comprises a continuous strap.

16. The support garment of claim 15, wherein the first strap is adjustably secured to the first securing location, and wherein the first strap is adjustably secured to the second securing location.

17. The support garment of claim 16, wherein the first strap is adjustably secured to the first securing location using at least a first slider mechanism, and wherein the first strap is adjustably secured to the second securing location using at least a second slider mechanism.

* * * * *